US010865667B2

(12) United States Patent
Tateno

(10) Patent No.: US 10,865,667 B2
(45) Date of Patent: Dec. 15, 2020

(54) INTERNAL COMBUSTION ENGINE

(71) Applicant: TOYOTA JIDOSHA KABUSHIKI KAISHA, Aichi-ken (JP)

(72) Inventor: Manabu Tateno, Shizuoka-ken (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/572,617

(22) Filed: Sep. 17, 2019

(65) Prior Publication Data

US 2020/0157979 A1 May 21, 2020

(30) Foreign Application Priority Data

Nov. 15, 2018 (JP) ..... 2018-214851

(51) Int. Cl.
*F01L 3/04* (2006.01)
*F01L 3/20* (2006.01)

(52) U.S. Cl.
CPC ..... *F01L 3/04* (2013.01); *F01L 3/20* (2013.01); *F01L 2301/00* (2020.05); *F01L 2303/00* (2020.05)

(58) Field of Classification Search
CPC ..... F01L 3/04; F01L 3/20; F01L 2301/00
See application file for complete search history.

(56) References Cited

U.S. PATENT DOCUMENTS 4,137,886 A * 2/1979 Hiramatsu ..... F01L 3/06 123/188.11
5,257,453 A * 11/1993 Neumann ..... B21K 1/22 29/888.4
2009/0114182 A1* 5/2009 Bush ..... F01L 3/06 123/188.3
2018/0142608 A1 5/2018 Uozumi

FOREIGN PATENT DOCUMENTS

JP 2018-87562 A 6/2018

* cited by examiner

*Primary Examiner* — Kevin A Lathers
(74) *Attorney, Agent, or Firm* — Hauptman Ham, LLP

(57) ABSTRACT

An internal combustion engine includes: intake and exhaust ports; an intake valve including an intake valve shaft and an intake valve head; and an exhaust valve including an exhaust valve shaft and an exhaust valve head. The surface of the intake valve includes an intake-valve-head front surface exposed in a combustion chamber when the intake valve is closed and an intake-valve-head back surface exposed in the intake port when the intake valve is closed. The surface of the exhaust valve includes an exhaust-valve-head front surface exposed in the combustion chamber when the exhaust valve is closed and an exhaust-valve-head back surface exposed in the exhaust port when the exhaust valve is closed. The arithmetic mean roughness of the whole exhaust-valve-head back surface is greater than the arithmetic mean roughness of each of the whole intake-valve-head front surface, the whole intake-valve-head back surface and the whole exhaust-valve-head front surface.

17 Claims, 7 Drawing Sheets

| | Intake stroke | | Compression stroke | | Expansion stroke | | Exhaust stroke | |
|---|---|---|---|---|---|---|---|---|
| | Front | Back | Front | Back | Front | Back | Front | Back |
| Intake valve | Mirror surface | Mirror surface | Mirror surface | – | Mirror surface | – | Mirror surface | – |
| Exhaust valve | Mirror surface | – | Mirror surface | – | Mirror surface | – | Mirror surface | Rough surface |
| Temperature | Valve > Intake air | | Valve > Intake air | | Valve < Combustion gas | | Valve < Exhaust gas | |
| | Reduce heat transfer to intake air from valve | | | | Reduce heat transfer to valve from combustion gas | | Front side: Reduce heat transfer to valve from combustion gas<br>Back side: promote heat release to valve from combustion gas | |

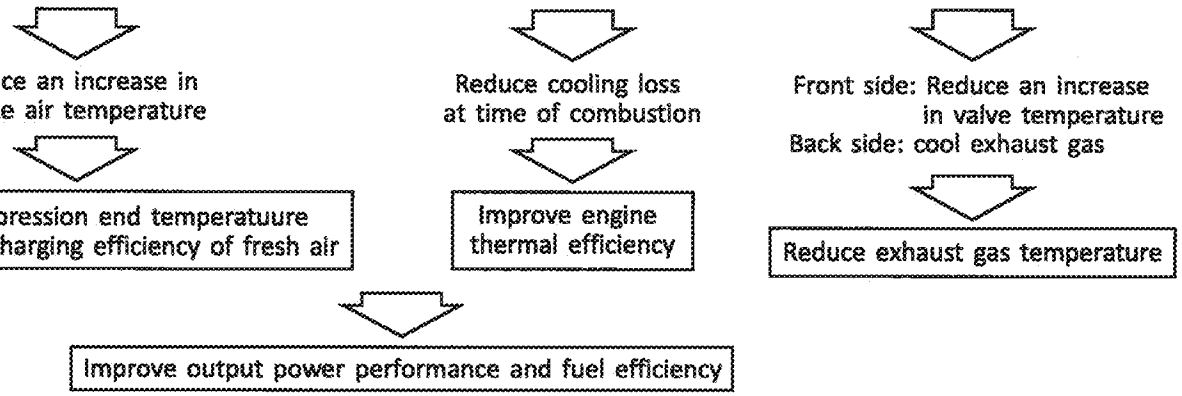

FIG. 3

INTERNAL COMBUSTION ENGINE

CROSS-REFERENCE TO RELATED APPLICATION

The present disclosure claims priority under 35 U.S.C. § 119 to Japanese Patent Application No. 2018-214851, filed on Nov. 15, 2018. The content of which is incorporated herein by reference in its entirety.

BACKGROUND

Technical Field

The present disclosure relates to an internal combustion engine, and more particularly to an internal combustion engine equipped with poppet intake and exhaust valves.

Background Art

For example, JP 2018-087562 A discloses an internal combustion engine equipped with poppet intake and exhaust valves. Each of valve surfaces located on the side closer to a combustion chamber than valve sheets in these respective intake and exhaust valves has a portion M included in a mirror surface whose arithmetic mean roughness is less than 0.3 μm and a portion R included in a rough surface whose arithmetic mean roughness is equal to or greater than 0.3 μm.

SUMMARY

There are the following requirements for intake and exhaust valves that respectively open and close intake and exhaust ports that communicate with a combustion chamber. That is to say, with regard to intake air, it is required, in view of the output power performance and fuel efficiency performance of an internal combustion engine, to reduce the heat transfer from the intake valve to the intake air as possible. With regard to exhaust gas, it is required, in view of reduction of the temperature of the exhaust gas discharged from the combustion chamber, to promote the heat transfer to the exhaust valve from the exhaust gas that flows through the exhaust port as possible. In addition, during combustion when the intake and exhaust valves are closed, it is required, in view of reduction of the cooling loss of the internal combustion engine, to reduce the heat transfer from combustion gas to the intake and exhaust valves as possible.

JP 2018-087562 A does not disclose how the arithmetic mean roughness of a surface of the intake valve located on the side exposed in an intake port when the intake valve is closed (in the present application, referred to as an "intake-valve-head back surface") and the arithmetic mean roughness of a surface of the exhaust valve located on the side exposed in an exhaust port when the exhaust valve is closed (referred to as an "exhaust-valve-head back surface") should be set. However, in order to properly meet the above-described requests regarding the temperature management of the intake air, the exhaust gas and the combustion gas, it is favorable to collectively and properly set not only the arithmetic mean roughness of each of surfaces of the intake and exhaust valves exposed on the combustion chamber side (referred to as an "intake-valve-head front surface" and an "exhaust-valve-head front surface") but also the arithmetic mean roughness of each of the intake-valve-head back surface and exhaust-valve-head back surface.

The present disclosure has been made to address the problem described above, and an object of the present disclosure is to provide an internal combustion engine that can properly perform temperature management of intake air, exhaust gas and combustion gas by the use of intake and exhaust valves.

An internal combustion engine according to the present disclosure includes: an intake port and an exhaust port which communicate with a combustion chamber; an intake valve including an intake valve shaft and an intake valve head, the intake valve head being arranged at an end of the intake valve shaft and opening and closing the intake port; and an exhaust valve including an exhaust valve shaft and an exhaust valve head, the exhaust valve head being arranged at an end of the exhaust valve shaft and opening and closing the exhaust port. The intake valve has a surface including an intake-valve-head front surface exposed in the combustion chamber when the intake valve is closed and an intake-valve-head back surface exposed in the intake port when the intake valve is closed. The exhaust valve has a surface including an exhaust-valve-head front surface exposed in the combustion chamber when the exhaust valve is closed and an exhaust-valve-head back surface exposed in the exhaust port when the exhaust valve is closed. An arithmetic mean roughness of the whole exhaust-valve-head back surface is greater than an arithmetic mean roughness of each of the whole intake-valve-head front surface, the whole intake-valve-head back surface and the whole exhaust-valve-head front surface.

The arithmetic mean roughness of the whole exhaust-valve-head back surface may be greater than 0.5 μm. The arithmetic mean roughness of each of the whole intake-valve-head front surface, the whole intake-valve-head back surface and the whole exhaust-valve-head front surface may also be equal to or less than 0.5 μm.

At least one groove may be formed in the exhaust-valve-head back surface.

The at least one groove may include a plurality of grooves that are formed in the exhaust-valve-head back surface so as to extend radially in a radial direction of the exhaust valve head.

Each of the plurality of grooves may be formed so as to become deeper at a portion of the exhaust valve head located radially outward than at a portion of the exhaust valve head located radially inward.

The arithmetic mean roughness of the whole of the exhaust-valve-head front surface and the exhaust-valve-head back surface may be greater than the arithmetic mean roughness of the whole of the intake-valve-head front surface and the intake-valve-head back surface.

The arithmetic mean roughness of the whole exhaust-valve-head back surface may be greater than the arithmetic mean roughness of the whole intake-valve-head back surface.

The arithmetic mean roughness of the whole intake-valve-head back surface may be greater than the arithmetic mean roughness of the whole intake-valve-head front surface.

The arithmetic mean roughness of the whole exhaust-valve-head front surface may be less than the arithmetic mean roughness of the whole intake-valve-head front surface.

An arithmetic mean roughness of a portion of the intake-valve-head front surface located radially outward of the intake valve head may be greater than an arithmetic mean roughness of a portion of the intake-valve-head front surface located radially inward of the intake valve head.

An arithmetic mean roughness of a portion of the intake-valve-head back surface located radially outward of the intake valve head may be less than an arithmetic mean roughness of a portion of the intake-valve-head back surface located radially inward of the intake valve head.

An arithmetic mean roughness of a portion of the exhaust-valve-head front surface located radially outward of the exhaust valve head may be less than an arithmetic mean roughness of a portion of the exhaust-valve-head front surface located radially inward of the exhaust valve head.

An arithmetic mean roughness of a portion of the exhaust-valve-head back surface located radially outward of the exhaust valve head may be greater than an arithmetic mean roughness of a portion of the exhaust-valve-head back surface located radially inward of the exhaust valve head.

The intake valve may include an intake front-surface coating layer which covers at least a part of the intake-valve-head front surface and an intake back-surface coating layer which covers at least a part of the intake-valve-head back surface. The intake front-surface coating layer may also be thinner than the intake back-surface coating layer.

A thickness of the intake front-surface coating layer may be equal to or less than the arithmetic mean roughness of the whole intake-valve-head front surface.

A thickness of the intake back-surface coating layer may be equal to or less than the arithmetic mean roughness of the whole intake-valve-head back surface.

The exhaust valve may include an exhaust front-surface coating layer which covers at least a part of the exhaust-valve-head front surface. The exhaust-valve-head back surface may also be not covered by a coating layer.

A thickness of the exhaust front-surface coating layer may be equal to or less than the arithmetic mean roughness of the whole exhaust-valve-head front surface.

According to the internal combustion engine of the present disclosure, the arithmetic mean roughness of the whole exhaust-valve-head back surface is set so as to become greater than the arithmetic mean roughness of each of the whole intake-valve-head front surface, the whole intake-valve-head back surface and the whole exhaust-valve-head front surface. In this regard, when the surface roughness of a valve decreases, the surface area of the valve decreases and thus the amount of heat that transfers between the valve and gas decreases. Conversely, when the surface roughness increases, the amount of heat transfer increases. Therefore, according to the internal combustion engine of the present disclosure, with regard to the intake and compression strokes, the heat transfer from the intake and exhaust valves to the intake air through the intake-valve-head front surface, the intake-valve-head back surface and the exhaust-valve-head front surface that are less in the roughness than the exhaust-valve-head back surface can be reduced. With the expansion stroke, the heat transfer from the combustion gas to the intake and exhaust valves through the intake-valve-head front surface and the exhaust-valve-head front surface that are less in the roughness as described above can be reduced. With the exhaust stroke, the heat transfer (heat release) to the exhaust valve from the exhaust gas through the exhaust-valve-head back surface that is relatively greater in the roughness can be promoted while reducing the heat transfer from the combustion gas to the intake and exhaust valves through the intake-valve-head front surface and the exhaust-valve-head front surface similarly to the expansion stroke. As described so far, according to the internal combustion engine of the present disclosure, temperature management of the intake air, the exhaust gas and the combustion gas can be properly performed by the use of the intake and exhaust valves.

BRIEF DESCRIPTION OF THE DRAWINGS

FIG. 3 is a diagram for describing advantageous effects of the setting of the surface roughness of each of the intake and exhaust valves around a combustion chamber and intake and exhaust ports according to the first embodiment of the present disclosure;

DETAILED DESCRIPTION

Figure 1:
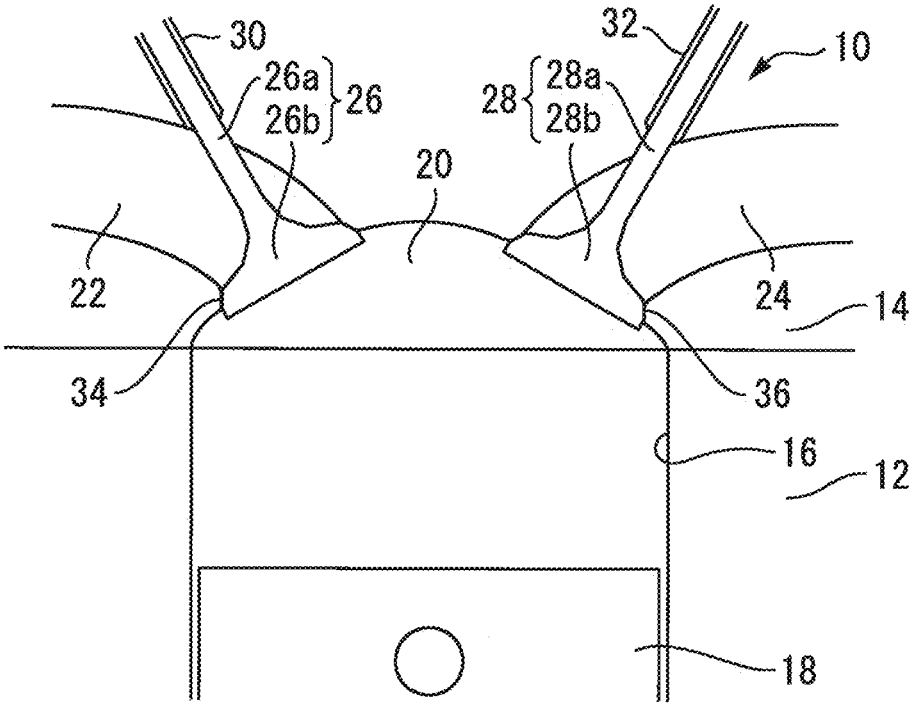
FIG. 1 is a schematic diagram for describing an example of the configuration of an internal combustion engine according to a first embodiment of the present disclosure.

In the following, embodiments of the present disclosure will be described with reference to the accompanying drawings. However, the same components in the drawings are denoted by the same reference numerals, and redundant descriptions thereof are omitted or simplified. Moreover, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Furthermore, structures or the like that are described in conjunction with the following embodiments are not necessarily essential to the present disclosure unless explicitly shown otherwise, or unless the present disclosure is explicitly specified by the structures or the like theoretically.

1. First Embodiment

A first embodiment according to the present disclosure will be described with reference to FIGS. 1 to 3.

1-1. Example of Configuration of Internal Combustion Engine

FIG. 1 is a schematic diagram for describing an example of the configuration of an internal combustion engine 10 according to the first embodiment of the present disclosure. As shown in FIG. 1, the internal combustion engine 10 is equipped with a cylinder block 12, and a cylinder head 14 fastened to an upper part of the cylinder block 12. Cylinder bores 16 are formed in the interior of the cylinder block 12. In each of these cylinder bores 16, a piston 18 that reciprocates in the axial direction of the relevant cylinder bore 16 is arranged. In each cylinder of the internal combustion engine 10, a combustion chamber 20 is defined by a wall surface of the relevant cylinder bore 16, an undersurface of the cylinder head 14, and a top surface of the piston 18.

In the cylinder head 14, an intake port 22 and an exhaust port 24 that communicate with the relevant combustion chamber 20 are formed. An intake valve 26 is provided in an opening portion of the intake port 22 which communicates with the combustion chamber 20. An exhaust valve 28 is provided in an opening portion of the exhaust port 24 which communicates with the combustion chamber 20. The intake valve 26 and the exhaust valve 28 are both poppet valves. The intake valve 26 is provided with an intake valve shaft 26*a* and an intake valve head 26*b* formed into an umbrella shape. The intake valve head 26 is arranged at an end of the intake valve shaft 26*a* and opens and closes the intake port 22. The exhaust valve 28 is provided with an exhaust valve shaft 28*a* and an exhaust valve head 28*b* formed into an umbrella shape. The exhaust valve head 28 is arranged at an end of the exhaust valve shaft 28*a* and opens and closes the exhaust port 24.

The intake valve shaft 26*a* and the exhaust valve shaft 28*a* are slidably supported by valve guides 30 and 32 installed in the cylinder head 14, respectively. In the intake port 22, a valve sheet 34 on which the intake valve head 26*b* is seated is arranged, and in the exhaust port 24, a valve sheet 36 on which the exhaust valve head 28*b* is seated is arranged. The intake valve 26 and the exhaust valve 28 are driven to open and close by the respective valve operating device which are not shown.

Figure 2:
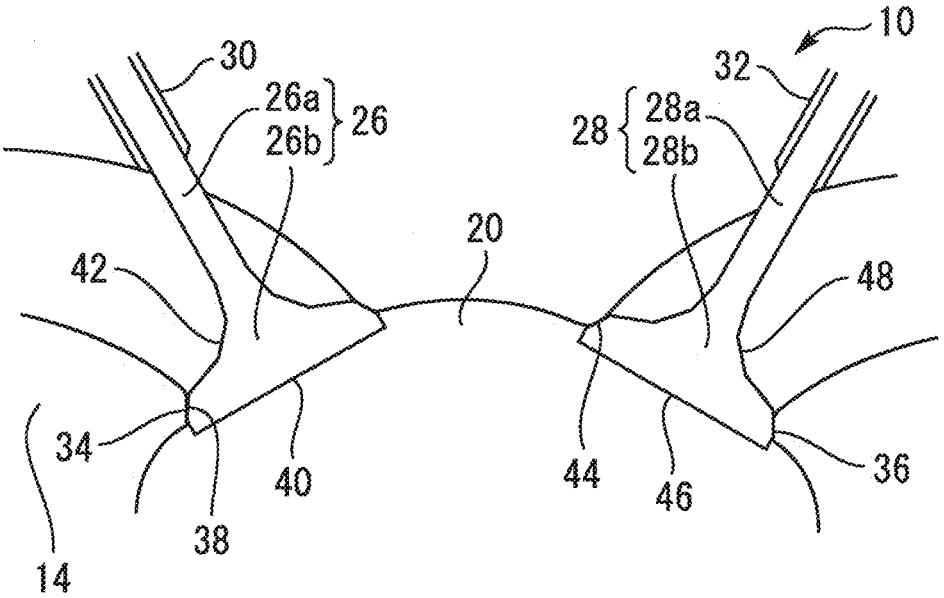
FIG. 2 is an enlarged diagram that illustrates a structure around intake and exhaust valves shown in FIG. 1.

FIG. 2 is an enlarged diagram that illustrates a structure around the intake and exhaust valves 26 and 28 shown in FIG. 1. The intake valve head 26*b* has a face surface (seat contact surface) 38 that contacts with the valve sheet 34 when the intake valve 26 is closed. The surface of the intake valve 26 includes an intake-valve-head front surface 40 and an intake-valve-head back surface 42 on both sides of the face surface 38, in addition to the face surface 38. The intake-valve-head front surface 40 refers to a surface of the intake valve 26 exposed in the combustion chamber 20 when the intake valve 26 is closed. The intake-valve-head back surface 42 refers to a surface of the intake valve 26 exposed in the intake port 22 when the intake valve 26 is closed. Because of this, the intake-valve-head back surface 42 is configured by a part of the surface of the intake valve head 26*b* and a part of the intake valve shaft 26*a* as shown in FIG. 2.

The exhaust valve head 28*b* has a face surface 44 that contacts with the valve sheet 36 when the exhaust valve 28 is closed. Also, similarly to the intake valve 26, the surface of the exhaust valve 28 includes an exhaust-valve-head front surface 46 exposed in the combustion chamber 20 when the exhaust valve 28 is closed and an exhaust-valve-head back surface 48 exposed in the exhaust port 24 when the exhaust valve 28 is closed. Moreover, the exhaust-valve-head back surface 48 is configured by a part of the surface of the exhaust valve head 28*b* and a part of the exhaust valve shaft 28*a* as shown in FIG. 2.

1-2. Setting of Surface Roughness of Intake and Exhaust Valves Around Combustion Chamber and Ports The internal combustion engine 10 according to the present embodiment has a feature in setting of the roughness of each of the intake-valve-head front surface 40, the intake-valve-head back surface 42, the exhaust-valve-head front surface 46 and exhaust-valve-head back surface 48.

In detail, with respect to the intake valve 26, both the intake-valve-head front surface 40 and the intake-valve-head back surface 42 are mirror-finished (mirror-polished). The mirror finish can be performed by, for example, polishing (grinding) a target surface of a valve. It should be noted that, in the present specification, a "mirror surface" refers to a surface whose arithmetic mean roughness Ra is equal to or less than 0.5 μm. In addition, as a pair with this "mirror surface", a surface whose arithmetic mean roughness Ra is greater than 0.5 μm may be referred to a "rough surface".

On the other hand, with regard to the exhaust valve 28, the exhaust-valve-head front surface 46 is mirror-finished (mirror-polished) similarly to the intake valve 26. However, the exhaust-valve-head back surface 48 is not mirror-finished. That is to say, the exhaust-valve-head back surface 48 is finished with the rough surface described above. To be more specific, examples of the "rough surface" mentioned here include such a forging surface (for example, 20 μm in the arithmetic mean roughness Ra) as to be used in a general manufacturing process of intake and exhaust valves, and a heat-treated surface or a surface-treated surface (for example, 1-20 μm in the arithmetic mean roughness Ra). The exhaust-valve-head back surface 48 is a forging surface as an example.

Additionally, in terms of achieving good heat release properties regarding a heat release to the exhaust valve 28 from exhaust gas in an exhaust stroke described below, it is desirable that the arithmetic mean roughness Ra of the whole exhaust-valve-head back surface 48 be equal to or greater than 20 μm. It should be noted that the arithmetic mean roughness Ra of a surface of an exhaust port that is opened and closed by an exhaust valve to which the present disclosure is applied corresponds to an example of an upper limit of the arithmetic mean roughness Ra of the "exhaust-valve-head back surface". This is because providing an exhaust-valve-head back surface that is rougher than the surface of the exhaust port leads to an increase in intake resistance.

As described so far, the arithmetic mean roughness Ra of each of the whole intake-valve-head front surface 40, the whole intake-valve-head back surface 42 and the whole exhaust-valve-head front surface 46 that are mirror-finished is equal to or less than 0.5 μm. On the other hand, the arithmetic mean roughness Ra of the whole exhaust-valve-head back surface 48 that is a rough surface is greater than 0.5 μm. Because of this, according to the internal combustion engine 10 of the present embodiment, the arithmetic mean roughness Ra of the whole exhaust-valve-head back surface 48 is greater than the arithmetic mean roughness Ra of each of the whole intake-valve-head front surface 40, the whole intake-valve-head back surface 42 and the whole exhaust-valve-head front surface 46.

Furthermore, according to the internal combustion engine 50 of the present embodiment, the intake-valve-head front surface 40 is finished such that the roughness thereof is even on the whole as an example. This also applies to the other intake-valve-head back surface 42, exhaust-valve-head front surface 46 and exhaust-valve-head back surface 48.

1-3. Advantageous Effects

Intake and exhaust valves of an internal combustion engine are exposed to the highest-temperature combustion gas in the internal combustion engine. Cooling of the intake and exhaust valves is performed when the intake and exhaust valves come into contact with individual portions (valve guides, valve sheets, cams and valve springs) of a cylinder head. However, since the intake and exhaust valves are reciprocating, it cannot be said that the cooling is enough, and in particular, the temperature of the exhaust valve exposed in a high temperature exhaust gas may become likely to be higher than those of a piston and a combustion chamber wall that are located around the exhaust valve.

In general, there are the following requirements for the intake and exhaust valves of the internal combustion engine that are placed in the environment described above. That is to say, with regard to intake air, it is required, in view of the output power performance and fuel efficiency performance of the internal combustion engine, to reduce the heat transfer from the intake valve to the intake air as possible. With regard to exhaust gas, it is required, in view of reduction of the temperature of the exhaust gas discharged from the combustion chamber, to promote the heat transfer to the exhaust valve from the exhaust gas that flows through an exhaust port as possible. In addition, during combustion when the intake and exhaust valves are closed, it is required, in view of reduction of the cooling loss of the internal combustion engine, to reduce the heat transfer from combustion gas to the intake and exhaust valves as possible. In view of this kind of issues (three requirements), according to the present embodiment, the intake-valve-head front surface 40, the intake-valve-head back surface 42 and the exhaust-valve-head front surface 46 are mirror-finished, and the exhaust-valve-head back surface 48 is not mirror-finished.

FIG. 3 is a diagram for describing advantageous effects of the setting of the surface roughness of each of the intake and exhaust valves 26 and 28 around the combustion chamber 20 and intake and exhaust ports 22 and 24 according to the first embodiment of the present disclosure. In FIG. 3, "Front" indicates a "head front surface" of each valve, and "Back" indicates a "head back surface" of each valve. Also, for each stroke of the internal combustion engine 10, FIG. 3 represents which of Mirror Surface and Rough Surface more greatly affects each stroke. In addition, since gas flow is less on surfaces corresponding to fields to which a symbol "-" is assigned, the advantageous effects described below are difficult to be sufficiently achieved. However, it can therefore be said that, since gas remains in the vicinity of a valve that is closed, the advantageous effects can somewhat be achieved.

The amount of heat that transfers between a valve (solid wall surface) and gas in a unit time is proportional to not only a temperature difference between the valve and the gas but also a surface area of the valve that comes into contact with the gas. Also, the surface area of the valve differs depending on the surface roughness of the valve and becomes greater when the surface roughness is greater. Because of this, when the surface roughness becomes less, the amount of heat that transfers between the valve and the gas becomes less, and, conversely, when the surface roughness becomes greater, the amount of heat transfer becomes greater. Furthermore, the amount of heat transfer also becomes greater when the flow rate of the gas that comes into contact with the valve becomes higher.

(Intake Stroke)

First, in the intake stroke, an intake valve is open and an exhaust valve is closed. As a result, in the intake stroke, intake air flows into a combustion chamber while passing through the vicinity of an intake-valve-head front surface. In addition, the gas around an intake-valve-head back surface and an exhaust-valve-head front surface corresponds to intake air that has flown into the combustion chamber.

The temperature of the intake air is basically equivalent to normal temperatures. Moreover, the intake and exhaust valves, walls of intake and exhaust ports, and a wall of the combustion chamber are generally cooled by a cooling water, and the temperatures thereof become 80 degrees C. or higher. Because of this, in the intake stroke, the temperature of each of the intake and exhaust valves becomes higher than the temperature of the gas (intake air) around these valves (Valve>Intake air). As a result, in the intake stroke, the temperature of the intake air that flows the intake port and the temperature of the intake air that has flown into the combustion chamber become higher due to the heat transferred from the intake and exhaust valves. In more detail, when the intake air is passing through the vicinity of the valve sheet, the flow velocity and pressure of the intake air increase and, as a result, the heat transfer from the intake valve to the intake air is promoted.

With regard to the intake stroke in which the heat transfer as described above is performed, according to the internal combustion engine 10 of the present embodiment, the following advantageous effects are achieved. That is to say, the intake-valve-head front surface 40 exposed in the intake port 22 is a mirror surface. In other words, an arrangement to reduce the area of the intake-valve-head front surface 40 is made. Because of this, when the intake air passes through the vicinity of the intake-valve-head back surface 42 in the intake port 22, the heat transfer from the intake valve 26 to the intake air can be reduced. In addition, the intake-valve-head front surface 40 and the exhaust-valve-head front surface 46 that are exposed in the combustion chamber 20 are also mirror surfaces. Because of this, the heat transfer from the intake port 22 to the intake air that has flown into the combustion chamber 20 can also be reduced. As a result, since an increase in the intake air temperature is reduced, a decrease in the compression end temperature and improvement of the charging efficiency of fresh air can be achieved. When the compression end temperature decreases, knocking is reduced, which leads to improvement of the fuel efficiency as well as improvement of the output power performance of the internal combustion engine 10. Furthermore, charging a greater amount of air due to a lower temperature air entering the combustion chamber 20 also leads to the improvement of the output power performance (Compression Stroke)

Then, in the compression stroke, the intake and exhaust valves are both closed. In view of the whole compression stroke, the temperatures of the intake and exhaust valves basically become higher than the temperature of the gas around these valves (Valve>Intake Air), although, in the vicinity of the compression end, the temperature of the intake air in the combustion chamber becomes higher than the temperatures of the intake and exhaust valves.

According to the internal combustion engine 10 of the present embodiment, the intake-valve-head front surface 40 and the exhaust-valve-head front surface 46 that are exposed in the combustion chamber 20 when the intake and exhaust valves are closed are mirror surfaces. Because of this, even in the compression stroke, the heat transfer from the intake and exhaust valves 26 and 28 to the intake air in the combustion chamber 20 can also be reduced.

(Expansion Stroke)

Then, in the expansion stroke, similarly, the intake and exhaust valves are both closed. However, in the expansion stroke, the temperature of the in-cylinder gas becomes higher than the temperatures of the intake and exhaust valves due to a temperature increase caused by the combustion (Valve<Combustion Gas).

According to the internal combustion engine 10 of the present embodiment, the intake-valve-head front surface 40 and the exhaust-valve-head front surface 46 are mirror surfaces. Because of this, in the expansion stroke, the heat transfer (heat release) from a high temperature combustion gas to the intake and exhaust valves 26 and 28 can be reduced. As a result, cooling loss at the time of combustion can be reduced. Because of this, the thermal efficiency of the internal combustion engine 10 can be improved. In addition, in the course of warm-up after an engine start-up, the effect of promoting the warm-up of a catalyst with a temperature increase of the exhaust gas can also be achieved by the reduction of the heat release from a high temperature combustion gas to the intake and exhaust valves 26 and 28, and, as a result, the exhaust gas emission performance during this warm-up can also be improved.

(Exhaust Stroke)

Then, in the exhaust stroke, the intake valve is closed and the exhaust valve is open. As a result, in the exhaust stroke, a high temperature exhaust gas after the combustion flows out into the exhaust port from the combustion chamber. In more detail, the exhaust gas temperature becomes higher especially during a high-load and high-speed operation. Because of this, in the exhaust stroke, similarly, the temperature of the gas (exhaust gas) becomes higher than the temperatures of the intake and exhaust valves (Valve<Exhaust gas).

According to the internal combustion engine 10 of the present embodiment, in the exhaust stroke, similarly, the intake-valve-head front surface 40 and the exhaust-valve-head front surface 46 that are located on the side exposed in the combustion chamber 20 are mirror surfaces. Thus, the heat transfer to these surfaces 40 and 46 from a high temperature exhaust gas can be reduced. On the other hand, the exhaust-valve-head back surface 48 is a rough surface. Because of this, when a high temperature exhaust gas passes through the vicinity of the exhaust-valve-head back surface 48 in the exhaust port 24, the heat transfer (heat release) to the exhaust-valve-head back surface 48 from the exhaust gas can be promoted as compared to an example in which the exhaust-valve-head back surface 48 is also a mirror surface. In addition, the effect of promoting the heat release to the exhaust-valve-head back surface 48 from the exhaust gas becomes high at a high-load and high-speed operation in which the flow rate of the exhaust gas is high. On the other hand, according to the measures using the setting of the surface roughness in the present embodiment, the heat capacity of the exhaust valve 28 is not caused to increase, in contrast to an example in which a protrusion portion, such as fins, are formed on the exhaust-valve-head back surface 48 to increase the surface area in order to promote the heat release. Because of this, according to the measures, it can be said that a decrease in the exhaust gas temperature is prevented from being promoted due to the fact that the heat release is promoted during a cold state (i.e., during an engine warm-up).

Based on the above, with regard to the exhaust stroke, the exhaust gas temperature can be reduced by cooing the exhaust gas by the use of a portion of the exhaust valve head 28*b* located far away from the combustion chamber 20, and a portion of the exhaust valve shaft 28*a* (i.e., portion closer to the exhaust-valve-head back surface 48) subsequent to the aforementioned portion, while reducing temperature increases of portions of the intake valve head 26*b* and exhaust valve head 28*b* that are closer to the combustion chamber 20 (i.e., portions in the vicinity of the intake-valve-head front surface 40 and the exhaust-valve-head front surface 46). As a result, the following advantageous effects can be achieved, for example. That is to say, the endurance reliability of exhaust system parts (for example, a turbine of a turbocharger and an exhaust gas purifying catalyst) including exhaust valve 28 can be improved. A cost required to achieve a high heat resistance (for example, material cost) can also be reduced. The fuel efficiency can also be improved owing to the reduction of fuel increment for cooling the exhaust system parts. Furthermore, limitation of the engine output power in terms of the exhaust gas temperature can be relaxed, and thus, the output power performance can be improved.

(Conclusion)

As described so far, according to the internal combustion engine 10 in which the intake-valve-head front surface 40, the intake-valve-head back surface 42 and the exhaust-valve-head front surface 46 are mirror surfaces and the exhaust-valve-head back surface 48 is a rough surface, the three requirements described above can be favorably satisfied due to a proper setting of the surface roughness of the intake and exhaust valves 26 and 28 around the combustion chamber 20 and intake and exhaust ports 22 and 24. As a result, the internal combustion engine 10 including the intake and exhaust valves 26 and 28 that can properly perform temperature management (temperature control) of the intake air, the exhaust gas and the combustion gas can be provided.

2. Second Embodiment

Then, a second embodiment according to the present disclosure will be described with reference to FIGS. 4 to 6.

2-1. Configuration of Exhaust-Valve-Head Back Surface

Figure 4A:
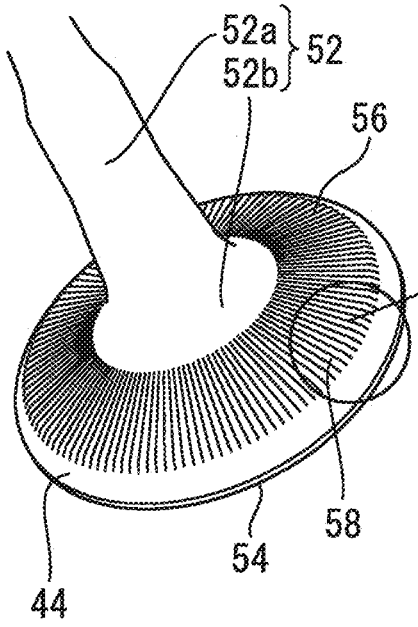
FIG. 4A is a whole perspective view that illustrates a main part of an exhaust valve according to a second embodiment of the present disclosure.
Figure 4B:
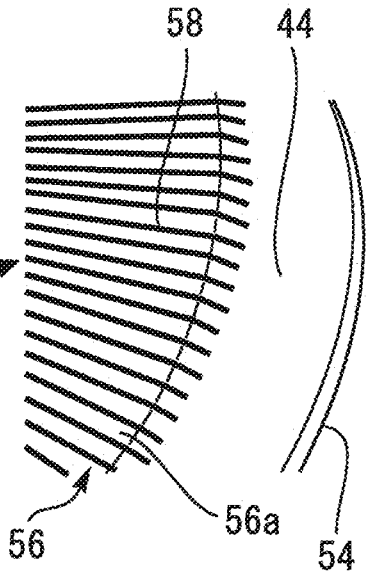
FIG. 4B is an enlarged view of a part of radial grooves shown in FIG. 4A.

FIG. 4A is a whole perspective view that illustrates a main part of an exhaust valve 52 according to the second embodiment of the present disclosure; and FIG. 4B is an enlarged view of a part of radial grooves 58 shown in FIG. 4A. An internal combustion engine 50 (see FIG. 6 described below) according to the second embodiment is different from the internal combustion engine 10 according to the first embodiment in terms of including the exhaust valve 52 shown in FIG. 4A, instead of the exhaust valve 28 shown in FIG. 1.

As shown in FIG. 4A, the exhaust valve 52 is provided with an exhaust valve shaft 52*a* and an exhaust valve head 52*b* formed into an umbrella shape. Similarly to the exhaust valve 28 shown in FIG. 1, the surface of the exhaust valve 52 includes an exhaust-valve-head front surface 54 exposed in the combustion chamber 20 and an exhaust-valve-head back surface 56 exposed in the exhaust port 24. On that basis, the radial grooves 58 are formed in the exhaust-valve-head back surface 56 according to the present embodiment.

As shown in FIGS. 4A and 4B, the radial grooves 58 refer to a plurality of grooves that are formed in the exhaust-valve-head back surface 56 so as to radially extend in the radial direction of the exhaust valve head 52*b*. In more detail, according to the example shown in FIG. 4A, the radial grooves 58 are formed in a surface of the exhaust valve head 52*b* included in the exhaust-valve-head back surface 56. According to the radial grooves 58 formed in this way, the area of the exhaust-valve-head back surface 56 can be increased.

Additionally, according to the example shown in FIG. 4A, the radial grooves 58 are not provided with respect to a portion located in the vicinity of the boundary between the exhaust valve shaft 52*a* and the exhaust valve head 52*b*. This is because this portion is most difficult to be cooled due to the fact that it is far away from each of the valve sheet 36 and a valve guide 60, and the temperature thereof thus becomes the highest. Accordingly, in this example, in order to reduce the heat input to the aforementioned portion from the exhaust gas, the radial grooves 58 are not formed.

On that basis, according to the example shown in FIG. 4A, the radial grooves 58 are formed in a surface of the exhaust valve head 52*b* included in the exhaust-valve-head back surface 56, and this surface is located radially outward of the exhaust valve head 52*b* except for the vicinity of the boundary described above.

Figure 5:
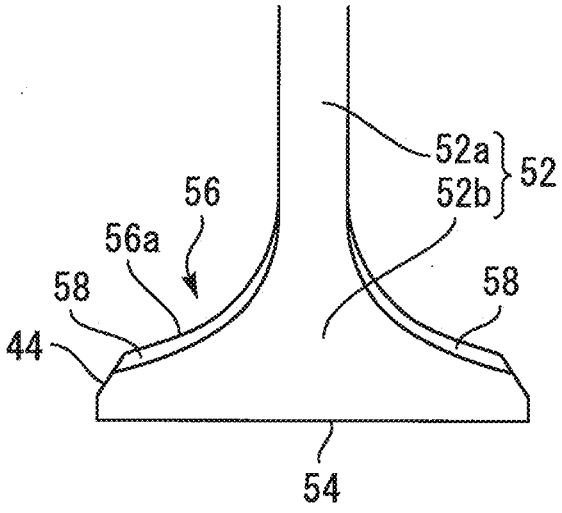
FIG. 5 is a cross-sectional view of the exhaust valve cut along the radial grooves shown in FIG. 4A.

FIG. 5 is a cross-sectional view of the exhaust valve 52 cut along the radial grooves 58 shown in FIG. 4A. As shown in FIG. 5, each groove of the radial grooves 58 is formed such that a radially outer portion of the exhaust valve head 52*b* is deeper than a radially inner portion thereof. In more detail, according to the example shown in FIG. 5, the radial grooves 58 are formed so as to become deeper toward the radially outer side.

Furthermore, the arithmetic mean roughness Ra of the whole exhaust-valve-head back surface 56 of the exhaust valve 52 on which this kind of radial grooves 58 are formed refers to an arithmetic mean roughness Ra of the whole base surface 56*a* of the exhaust-valve-head back surface 56 other than the radial grooves 58. In addition, the depth of the radial grooves 58 is greater than the arithmetic mean roughness Ra of the whole exhaust-valve-head back surface 56.

The radial grooves 58 shown in FIGS. 4A, 4B and 5 can be formed by using electro-discharge machining, for example. In detail, in an example of the electro-discharge machining, a radial electrode associated with the shape of the radial grooves 58 (workpiece) is prepared. Next, the exhaust valve 52 is inserted into the interior of this electrode, and electric discharge is then performed with the electrode pressed against the exhaust-valve-head back surface 56. As a result, the radial grooves 58 are formed. It should be noted that, if the electric-discharge machining is performed for the exhaust-valve-head back surface 56 in order to form the radial grooves 58, a surface roughness that properly meets the requirement of the "rough surface" described above is obtained due to the nature of the electric-discharge machining Based on this reason, the electro-discharge machining is suitable for forming the radial grooves 58, although the manner of forming the radial grooves 58 is not particularly limited.

2-2. Other Configurations Around Exhaust Valve

Figure 6:
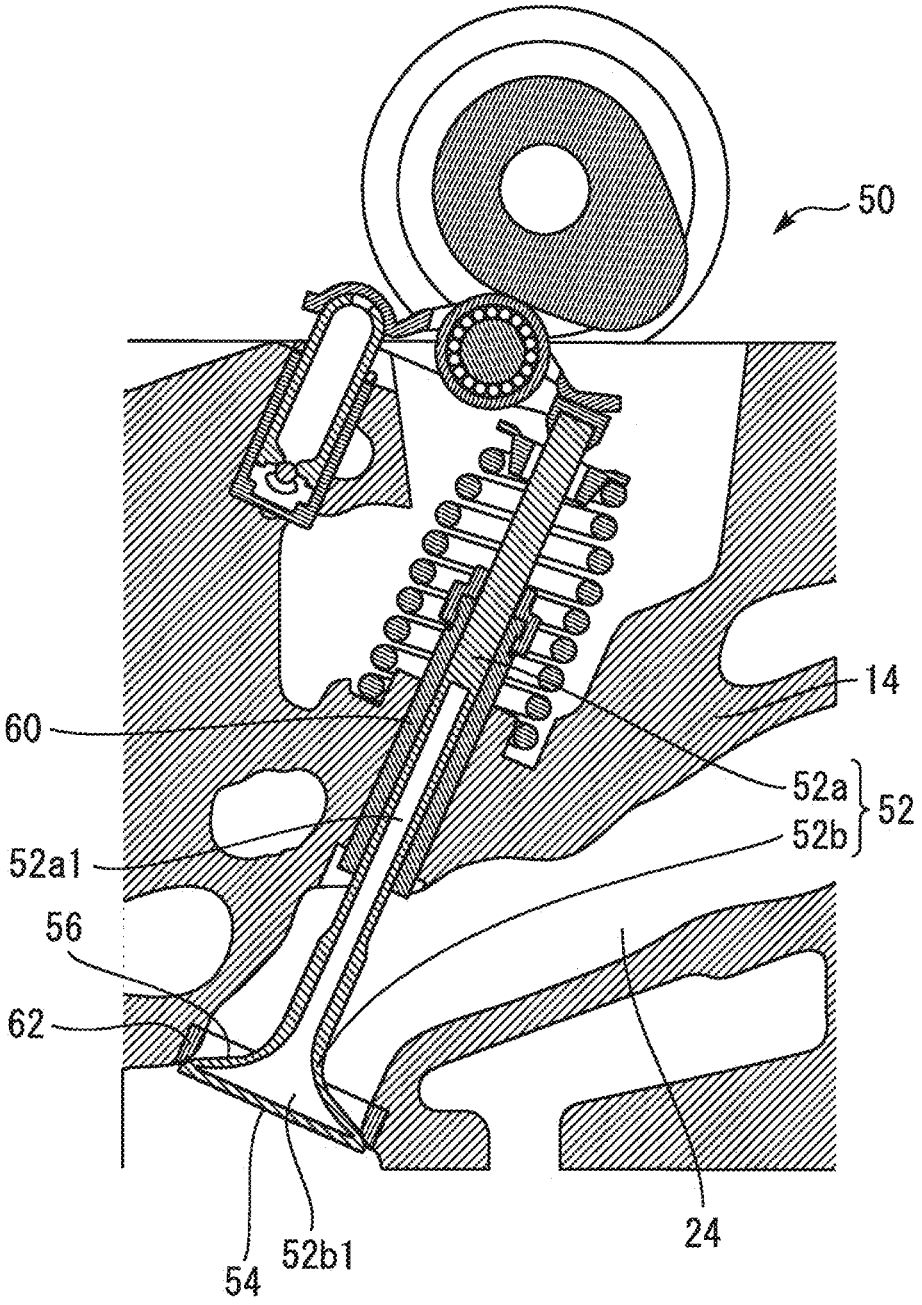
FIG. 6 is a diagram for describing a configuration around the exhaust valve in an internal combustion engine according to the second embodiment of the present disclosure.

FIG. 6 is a diagram for describing a configuration around the exhaust valve 52 in the internal combustion engine 50 according to the second embodiment of the present disclosure. According to the internal combustion engine 50 of the present embodiment, each of the valve guide 60 for holding the exhaust valve shaft 52*a* and the valve sheet 62 on which the exhaust valve head 52*b* is seated is configured to have a high thermal conductivity. In detail, the valve guide 60 and the valve sheet 62 are made of an alloy containing a metal having a high thermal conductivity (for example, copper) as a main component.

Moreover, each of the exhaust valve shaft 52*a* and the exhaust valve head 52*b* has a hollow structure as shown in FIG. 6. Furthermore, the respective hollow portions 52*a*1 and 52*b*1 of the exhaust valve shaft 52*a* and exhaust valve head 52*b* are filled with a refrigerant (for example, Natrium). It should be noted that the hollow portion 52*a*1 communicates with the hollow portion 52*b*1.

2-3. Advantageous Effects

As described so far, the radial grooves 58 are formed in the exhaust-valve-head back surface 56 of the exhaust valve 52 according to the present embodiment. As a result, the area of the exhaust-valve-head back surface 56 becomes greater, and the heat release to the exhaust valve 52 from a high temperature exhaust gas can thus be promoted. In addition, in order to promote the heat release to the exhaust valve from a high temperature exhaust gas, a protrusion portion, such as fins, may be formed on the exhaust-valve-head back surface. However, the measures using the protrusion portion formed in this way is good in terms of promoting the heat release, and, on the other hand, this adversely affects the engine performance due to an increase in the weight of the exhaust valve and an increase in pressure loss of the exhaust gas. In contrast to this, according to the measures using the formation of the grooves, the heat release to the exhaust valve 52 from the exhaust gas can be favorably promoted without the above-described adverse effect to the engine performance. This similarly applies to measures according to another example of increasing the surface area described below in section 2-4-2.

Moreover, according to the example shown in FIG. 4A, with regard to the radial direction of the exhaust valve head 52*b*, the radial grooves 58 are formed in the surface of the exhaust valve head 52*b* included in the exhaust-valve-head back surface 56, and this surface is located radially outward of the exhaust valve head 52*b* except for the vicinity of the boundary between the exhaust valve shaft 52*a* and the exhaust valve head 52*b*. In this regard, the temperature of the exhaust gas that flows out into the exhaust port 24 from the combustion chamber 20 becomes the highest at the start timing of opening of the exhaust valve 52 that is closer to the combustion period and then decreases during the subsequent exhaust stroke. Also, at the start timing of the opening, the pressure of the exhaust gas is high, and the flow velocity of the exhaust gas that passes through the vicinity of the exhaust-valve-head back surface 56 thus becomes high. As a result, the heat transfer coefficient of the exhaust gas becomes high, and the heat exchange between the exhaust gas and the exhaust valve 52 is thus promoted. Consequently, by forming the radial grooves 58 targeted for the radially outer portion that is other than the aforementioned portion located in the vicinity of the boundary, the heat release to the exhaust valve 52 from the exhaust gas can be favorably promoted due to an increase in the surface area by the use of the radial grooves 58.

Moreover, each groove of the radial grooves 58 is formed such that the radially outer portion of the exhaust valve head

52*b* is deeper than the radially inner portion thereof. As a result, the surface area of the radially outer portion becomes greater than that of the radially inner portion. That is to say, the surface area is managed by the setting of the groove depth. As described above, the radially outer portion of the exhaust valve head 52*b* corresponds to a portion that comes into contact with the exhaust gas whose temperature and pressure become the highest due to the start timing of the opening of the exhaust valve 52. Because of this, according to the radial grooves 58 on which the groove depth is set as described above, the heat release to the exhaust valve 52 from a high temperature exhaust gas at the start timing of the opening can be effectively promoted.

Furthermore, the exhaust-valve-head back surface 56 according to the present embodiment is finished with a rough surface similarly to the first embodiment in order to promote the heat release to the exhaust valve 52 from a high temperature exhaust gas. In addition, the exhaust valve 52 is configured to be able to easily transfer heat from a high temperature exhaust gas due to an increase in the area of the exhaust-valve-head back surface 56 as a result of the formation of the radial grooves 58. These mean that the temperature of the exhaust valve head 52*b* becomes easy to be higher due to the heat from the exhaust gas. In this regard, according to the internal combustion engine 50 provided with the exhaust valve 52, the respective hollow portions 52*a*1 and 52*b*1 of the exhaust valve shaft 52*a* and the exhaust valve head 52*b* are filled with the refrigerant. As a result, the transfer of heat to the exhaust valve shaft 52*a* from a high temperature exhaust valve head 52*b* can be promoted by the use of the refrigerant that moves in the hollow portions 52*a*1 and 52*b*1 associated with the motion of the exhaust valve 52. Also, according to the internal combustion engine 50, each of the valve guide 60 and the valve sheet 62 is configured to have a high thermal conductivity. This allows the heat transferred to the exhaust valve shaft 52*a* from the exhaust valve head 52*b* to be easy to be released to the cylinder head 14 via the valve guide 60. Similarly, the heat of the exhaust valve head 52*b* can be easy to be released to the cylinder head 14 via the valve sheet 62. As above, according to these configurations, the temperature of the exhaust valve head 52*b* that becomes easy to be high due to the fact that it effectively receives the heat from the exhaust gas can be reduced.

2-4. Modification Examples with Respect to Second Embodiment

2-4-1. Other Examples Concerning Formation of Grooves on Exhaust-Valve-Head Back Surface According to the second embodiment described above, the radial grooves 58 (a plurality of grooves) are formed in the exhaust-valve-head back surface 56. However, the number of grooves formed in the "exhaust-valve-head back surface" according to the present disclosure is not particularly limited, and thus, at least one desired groove other than the example shown in FIG. 4A may be formed in the exhaust-valve-head back surface.

Moreover, the at least one groove on the exhaust-valve-head back surface may be formed in any shape other than the radial shape. Furthermore, the formation range of each groove in the example of the radial grooves is not limited to the example of the radial grooves 58 shown in FIG. 4A, and may be freely set. Accordingly, the radial grooves may be formed, for example, not only on the exhaust-valve-head back surface 56 included in the exhaust valve head 52*b* but also on the exhaust-valve-head back surface 56 included in the exhaust valve shaft 52*a*. In addition, grooves formed on the side of the exhaust valve head 52*b* and grooves formed on the side of the exhaust valve shaft 52*a* may be continuous or separate from each other. Furthermore, in contrast to the example shown in FIG. 4A, the depth of each groove of the radial grooves may be constant, or the depth may be different from each other between each groove of the radial grooves.

2-4-2. Examples Other than Grooves for Increasing Area of Exhaust-Valve-Head Back Surface In another example of increasing the area of the "exhaust-valve-head back surface" according to the present disclosure, a surface treatment for increasing the surface area may be applied to an exhaust valve, instead of the example of the grooves (radial grooves 58) according to the second embodiment. In detail, the area of the exhaust-valve-head back surface may be increased by roughening the exhaust-valve-head back surface in a shape (for example, a texture shape, or a shape with matte or satin finish) by using, for example, shot blasting or electric-discharge machining.

3. Third Embodiment

Then, a third embodiment according to the present disclosure will be described with reference to FIGS. 7 and 8.

In the internal combustion engine 10 according to the first embodiment described above, each of the intake-valve-head front surface 40, the intake-valve-head back surface 42, the exhaust-valve-head front surface 46 and the exhaust-valve-head back surface 48 is finished such that the roughness becomes even on the whole, as already described. In contrast to this, an intake valve 70 and an exhaust valve 80 according to the third embodiment are different from the intake valve 26 and the exhaust valve 28, respectively, in the points described below with reference to FIGS. 7 and 8.

3-1. Setting of Roughness of Each Surface of Intake Valve

Figure 7:
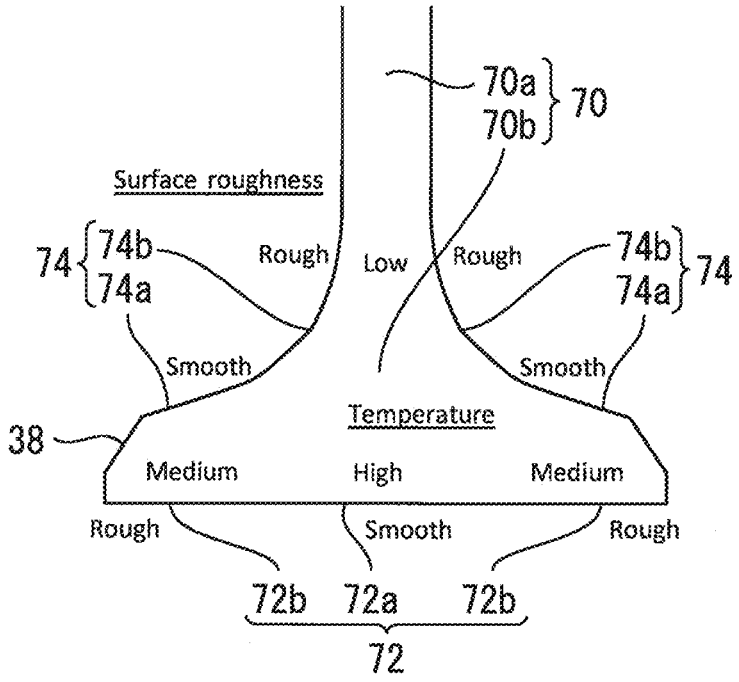
FIG. 7 is a diagram for describing an example of the setting of the surface roughness of individual portions of an intake valve according to a third embodiment of the present disclosure.

FIG. 7 is a diagram for describing an example of the setting of the surface roughness of individual portions of the intake valve 70 according to the third embodiment of the present disclosure. According to the intake valve 70, as shown in FIG. 7, the roughness of individual portions included in each of an intake-valve-head front surface 72 and an intake-valve-head back surface 74 is set so as to differ on the basis of an average temperature distribution of the intake valve 70.

In detail, the average temperature distribution of the intake valve 70 mentioned here refers to a distribution of the average temperature of the intake valve 70 (more specifically, the whole intake valve head 70*b* covered by the intake-valve-head front surface 72 and intake-valve-head back surface 74, and a part of the intake valve shaft 70*a*) targeted for all strokes of intake, compression, expansion and exhaust. This kind of average temperature distribution can be obtained by conducting an experiment or simulation in advance. This also applies to an average temperature distribution of the exhaust valve 80 described below.

According to the average temperature distribution of the intake valve 70, as shown in FIG. 7, the temperature of the intake valve 70 becomes the highest at a portion in the vicinity of a central portion 72*a* of the intake-valve-head front surface 72. This is because the effect of heat received from a high temperature burned gas in the expansion and exhaust strokes is high. The temperature of the intake valve 70 becomes higher at a portion in the vicinity of an end of the intake valve head 70*b* located radially outward, following the portion in the vicinity of the central portion 72*a*. In addition, the temperature of the intake valve 70 becomes lower at a portion in the vicinity of the boundary between the intake valve head 70*b* and the intake valve shaft 70*a* than the former two portions.

According to the intake valve 70, the roughness of each portion of the individual surfaces 72 and 74 of the intake valve 70 is set as follows in consideration of the average temperature distribution described above. That is to say, the arithmetic mean roughness Ra of a portion 72*b* of the intake-valve-head front surface 72 located radially outward of the intake valve head 70*b* is set so as to become greater than that of the portion (central portion) 72*a* of the intake-valve-head front surface 72 located radially inward. In addition, the arithmetic mean roughness Ra of a portion 74*a* of the intake-valve-head back surface 74 located radially outward of the intake valve head 70*b* is set so as to become less than that of a portion 74*b* of the intake-valve-head back surface 74 located radially inward thereof.

3-2. Setting of Roughness of Each Surface of Exhaust Valve

Figure 8:
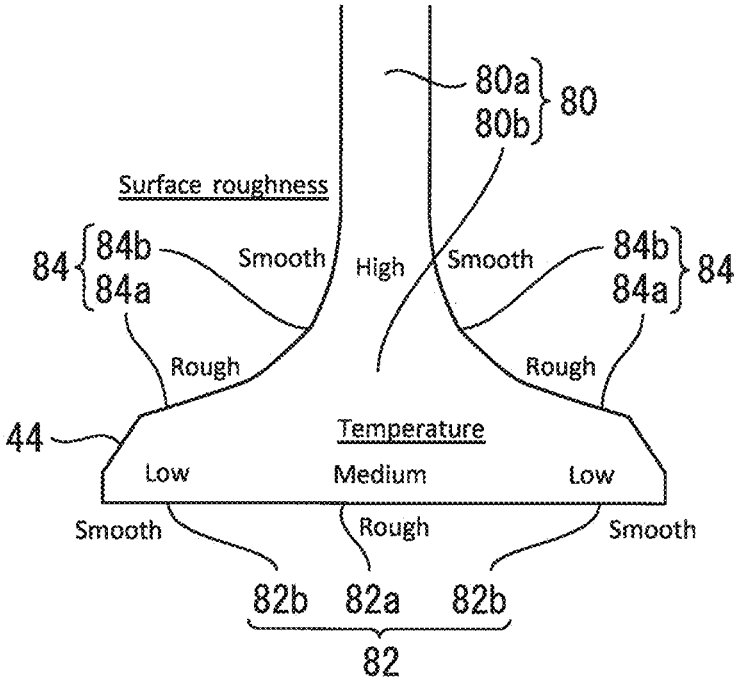
FIG. 8 is a diagram for describing an example of the setting of the surface roughness of individual portions of an exhaust valve according to the third embodiment of the present disclosure.

FIG. 8 is a diagram for describing an example of the setting of the surface roughness of individual portions of the exhaust valve 80 according to the third embodiment of the present disclosure. According to the exhaust valve 80, as shown in FIG. 8, the roughness of individual portions included in each of the exhaust-valve-head front surface 82 and the exhaust-valve-head back surface 84 is set so as to differ on the basis of an average temperature distribution of the exhaust valve 80.

According to the average temperature distribution of the exhaust valve 80, as shown in FIG. 8, the temperature of the exhaust valve 80 becomes the highest at a portion in the vicinity of the boundary between the exhaust valve head 80*b* and the exhaust valve shaft 80*a*. The reason is as already described in the second embodiment. The temperature of the exhaust valve 80 becomes higher at a portion in the vicinity of a central portion 82*a* of the exhaust-valve-head front surface 82, following the portion in the vicinity of the boundary described above. In addition, the temperature of the exhaust valve 80 becomes lower at a portion in the vicinity of a radially outer end of the exhaust valve head 80*b* than the former two portions.

According to the exhaust valve 80, the roughness of each portion of the individual surfaces 82 and 84 of the exhaust valve 80 are set as follows in consideration of the average temperature distribution described above. That is to say, the arithmetic mean roughness Ra of a portion 82*b* of the exhaust-valve-head front surface 82 located radially outward of the exhaust valve head 80*b* is set so as to become less than that of the portion (central portion) 82*a* of the exhaust-valve-head front surface 82 located radially inward. In addition, the arithmetic mean roughness Ra of a portion 84*a* of the exhaust-valve-head back surface 84 located radially outward of the exhaust valve head 80*b* is set so as to become greater than that of a portion 84*b* of the exhaust-valve-head back surface 84 located radially inward thereof.

3-3. Conclusion of Relationship of Roughness Between Each Surface of Intake and Exhaust Valves Even in the present embodiment, the arithmetic mean roughness Ra of each of the whole intake-valve-head front surface 72, the whole intake-valve-head back surface 74 and the whole exhaust-valve-head front surface 82 that are mirror-finished is equal to or less than 0.5 μm, and the arithmetic mean roughness Ra of the whole exhaust-valve-head back surface 84 that is roughly finished is greater than 0.5 μm.

Then, the average temperature of a portion A (i.e., the whole exhaust valve head 80*b* and a part of the exhaust valve shaft 80*a*) covered by the exhaust-valve-head front surface 82 and the exhaust-valve-head back surface 84 is higher than the average temperature of a portion B (i.e., the whole intake valve head 70*b* and a part of the intake valve shaft 70*a*) covered by the intake-valve-head front surface 72 and the intake-valve-head back surface 74. Therefore, with regard to the comparison between these portions A and B, according to the present embodiment, the arithmetic mean roughness Ra of the whole of the exhaust-valve-head front surface 82 and the exhaust-valve-head back surface 84 is set so as to become greater than that of the whole of the intake-valve-head front surface 72 and the intake-valve-head back surface 74.

(Relationships of Roughness Between Head Front Surfaces and Head Back Surfaces of Intake and Exhaust Valves)

Additionally, according to the present embodiment, relationships of roughness of the head front surfaces 72 and 82 and the head back surfaces 74 and 84 of the intake and exhaust valves 70 and 80 are as follows. That is to say, first, the arithmetic mean roughness Ra of the whole exhaust-valve-head back surface 84 that is a rough surface is greater than the arithmetic mean roughness Ra of the whole intake-valve-head back surface 74 that is a mirror surface.

Moreover, as can be seen from the average temperature distribution shown in FIG. 7, the average temperature of the portion in the vicinity of the intake-valve-head front surface 72 is higher than that of the portion in the vicinity of the intake-valve-head back surface 74. According to the present embodiment where this point is taken into consideration, the arithmetic mean roughness Ra of the whole intake-valve-head back surface 74 is set so as to become greater than the arithmetic mean roughness Ra of the whole intake-valve-head front surface 72.

Furthermore, with regard to the exhaust stroke, in the vicinity of the intake-valve-head front surface 72, the flow velocity of the gas becomes relatively low because the intake valve 70 is closed, and, on the other hand, in the vicinity of the exhaust-valve-head front surface 82, the flow velocity of the gas becomes relatively high because the exhaust gas flows out into the exhaust port 24 through the vicinity of the exhaust valve 80 which is open. Because of this, the average temperature of the portion in the vicinity of the exhaust-valve-head front surface 82 becomes higher than that of the portion in the vicinity of the intake-valve-head front surface 72. According to the present embodiment where this point is taken into consideration, the arithmetic mean roughness Ra of the whole exhaust-valve-head front surface 82 is set so as to become less than the arithmetic mean roughness Ra of the whole intake-valve-head front surface 72.

3-4. Advantageous Effects

As described above, the temperatures of intake and exhaust valves become different depending on portions. According to the intake and exhaust valves 70 and 80 of the present embodiment described so far, the surface roughness of each portion is set in consideration of this kind of temperature difference. Therefore, the heat release and heat receipt between valves and gases as described with reference to FIG. 3 in the first embodiment can be more effectively promoted.

3-5. Modification Examples with Respect to Third Embodiment

In the intake-valve-head front surface 72 according to the third embodiment described above, the surface roughness is changed in two stages between the portion 72*a* located radially inward of the intake valve head 70*b* and the portion 72*b* located radially outward thereof. However, instead of this kind of example, the surface roughness of each portion included in the intake-valve-head front surface 72 may be changed in desired three or more stages in accordance with the radial position, or be gradually (continuously) changed in accordance with the radial position. This also applies to the other intake-valve-head back surface 74, exhaust-valve-head front surface 82 and exhaust-valve-head back surface 84. In addition, in practice, it is difficult to perform a surface finishing (in particular, a mirror finish) to make uniform the overall roughness of each of the surfaces 72, 74, 82 and 84 of the intake and exhaust valves 70 and 80 and the cost also becomes easy to increase. In this regard, by gradually changing the surface roughness of each portion included in the intake-valve-head front surface 72 (similarly, in the other surfaces 74, 82 and 84) in accordance with the radial position as described above (i.e., by not making the overall roughness uniform), the surface finishing (in particular, a mirror finish) of each of the surfaces 72, 74, 82 and 84 can be simplified. Furthermore, with regard to the surfaces 72, 82 and 84 to be mirror-finished, by changing, for example, the strength of applying a grindstone to these surfaces 72, 82 and 84 between the radially inner position and the radial outer position of each of the valve heads 70*b* and 80*b*, the surfaces 72, 82 and 84 whose roughness is gradually changed in accordance with the radial position can be obtained.

4. Fourth Embodiment

Then, a fourth embodiment according to the present disclosure will be described with reference to FIGS. 9 to 12.

4-1. Coating of Intake and Exhaust Valves

An intake valve 90 and an exhaust valve 100 according to the fourth embodiment are different from the intake valve 26 and the exhaust valve 28 according to the first embodiment, respectively, in terms of coating described below. It should be noted that the coating described below may be applied to the intake valve 70 and the exhaust valves 52 and 80 according to other second and third embodiments.

Figure 9:
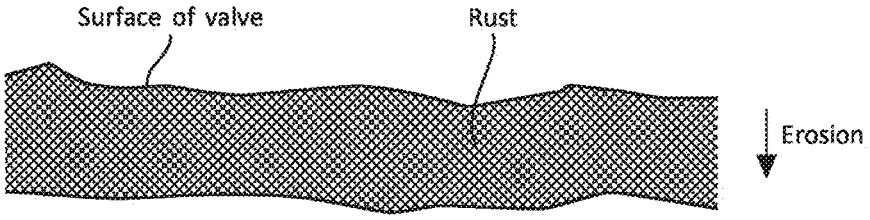
FIG. 9 is a diagram for describing an issue related to the mirror finish of the surface of a valve.

FIG. 9 is a diagram for describing an issue related to the mirror finish of the surface of a valve. In general, the surface of a valve (intake and exhaust valves) is protected by a protective film, such as an oxidized film. However, when a mirror finish is applied to the surface of the valve, the protective film is lost, and thus rust may be produced on the surface of the valve. To be more specific, the residual gas in a combustion chamber contains moisture. Thus, condensation is produced because the valve is cooled after an engine stop, and as a result, the rust is produced. This leads to a decrease in the thermal conductivity. Moreover, when the rust is produced on the surface of the valve, in contrast to when carbon or deposits are attached to the surface of the valve, the rust erodes and grows inside the metal as shown in FIG. 9, and the thickness of the rust increases. If the thermal conductivity decreases, heat becomes hard to be transferred and the heat in the interior of the valve becomes difficult to be removed. That is to say, a portion on which the rust is produced serves as a heat insulating layer. Also, the valve is arranged at a location where cooling thereof is inherently difficult. Thus, if the rust is produced on the surface of the valve on the side of the combustion chamber, the surface of the valve may become a heat spot. Furthermore, if the thickness of the rust becomes greater, the surface roughness becomes greater and the heat capacity also becomes greater. As a result, the effect of the mirror finish decreases with the growth of the rust.

Figure 10:
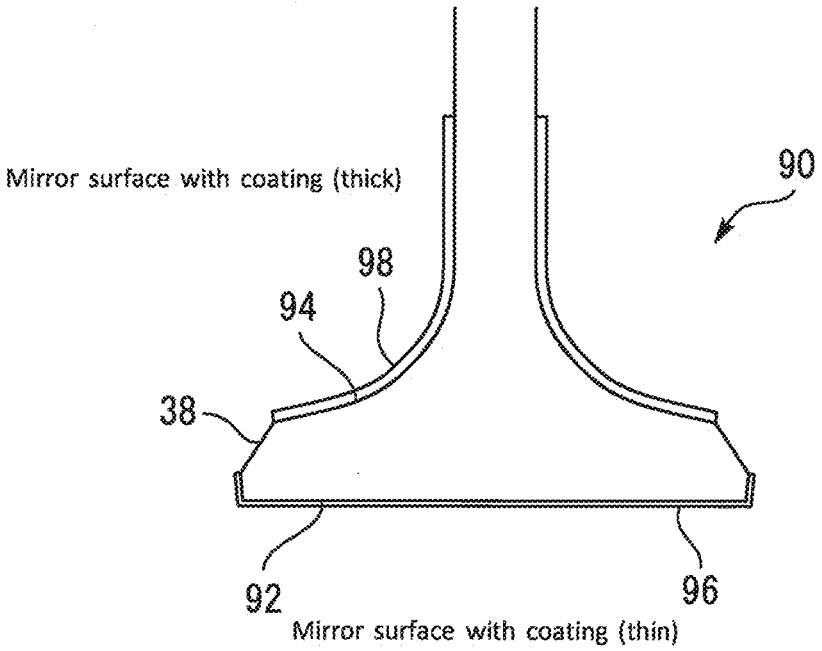
FIG. 10 is a schematic diagram for describing an example of the configuration of an intake valve according to a fourth embodiment of the present disclosure.

FIG. 10 is a schematic diagram for describing an example of the configuration of the intake valve 90 according to the fourth embodiment of the present disclosure. It should be noted that, in FIG. 10, coating layers 96 and 98 are schematically represented by thicknesses different from the actual thicknesses in order to easily express the installation locations of the coating layers 96 and 98. This also applies to an exhaust front-surface coating layer 106 shown in FIG. 11, which will be described below.

Similarly to the first embodiment, an intake-valve-head front surface 92 and an intake-valve-head back surface 94 are mirror-finished. On that basis, the intake valve 90 includes an intake front-surface coating layer 96 that covers the intake-valve-head front surface 92, and an intake back-surface coating layer 98 that covers the intake-valve-head back surface 94. That is to say, according to the intake valve 90, a coating processing is applied to the individual surfaces 92 and 94 after the mirror finish. In addition, the intake front-surface coating layer 96 is formed so as to be thinner than the intake back-surface coating layer 98.

Furthermore, the intake front-surface coating layer 96 and the intake back-surface coating layer 98 are formed so as to cover the whole intake-valve-head front surface 92 and the whole intake-valve-head back surface 94, respectively. However, the intake front-surface coating layer 96 may not always cover the whole intake-valve-head front surface 92, and may thus cover only a desired part thereof. This also applies to the intake back-surface coating layer 98.

Although coating materials used for forming the coating layers 96 and 98 are not particularly limited, in general, an example thereof is obtained by using a material containing silicon, such as polysilazane ($SiH_2NH$), as a base material and melting the base material into an organic material. By the use of the coating material exemplified as just described, the fluidity is increased in the material stage before application, and also a thin layer is obtained in which the coating material favorably permeates uneven surface of the valve when a coating layer is produced. Then, a cure treatment is performed on the obtained layer. As a result, the coating layer that is strong and resistant to heat can be formed. This also applies to the exhaust front-surface coating layer 106.

Figure 11:
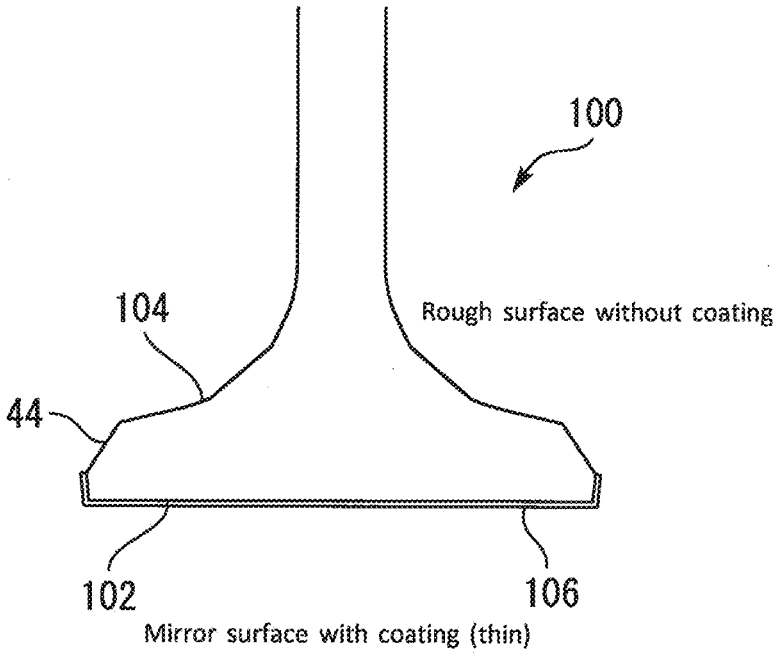
FIG. 11 is a schematic diagram for describing an example of the configuration of an exhaust valve according to the fourth embodiment of the present disclosure.

FIG. 11 is a schematic diagram for describing an example of the configuration of the exhaust valve 100 according to the fourth embodiment of the present disclosure. Similarly to the first embodiment, an exhaust-valve-head front surface 102 is mirror-finished, and, on the other hand, an exhaust-valve-head back surface 104 is roughly finished. On that basis, the exhaust valve 100 includes the exhaust front-surface coating layer 106 that covers the exhaust-valve-head front surface 102. That is to say, according to the exhaust valve 100, a coating processing is applied to the exhaust-valve-head front surface 102 after the mirror finish. On the other hand, the exhaust-valve-head back surface 104 that is a rough surface is not covered by a coating layer. The exhaust front-surface coating layer 106 is formed thinly with a thickness equivalent to the intake front-surface coating layer 96 as an example.

Furthermore, the exhaust front-surface coating layer 106 is formed so as to cover the whole exhaust-valve-head front surface 102. However, the exhaust front-surface coating layer 106 may not always cover the whole exhaust-valve-head front surface 102, and may thus cover only a desired part thereof.

Figure 12:
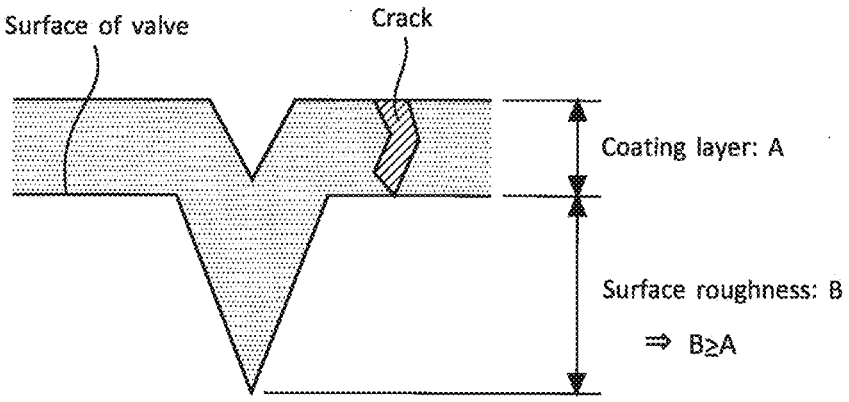
FIG. 12 is a diagram for describing a relationship between the thickness of each of coating layers shown in FIGS. 10 and 11 and the roughness of each of valve surfaces corresponding thereto.

FIG. 12 is a diagram for describing a relationship between the thickness of each of the coating layers 96, 98 and 106 shown in FIGS. 10 and 11 and the roughness of each of the valve surfaces 92, 94 and 102 corresponding thereto. Broadly speaking, the thickness of each of the coating layers 96, 98 and 106 is not particularly limited. On that basis, according to the present embodiment, the thickness of each of the coating layers 96, 98 and 106 is set as follows, in order not to reduce the effects of the mirror finish of the valve surfaces 92, 94 and 102 corresponding thereto as possible.

In FIG. 12, an example of the relationship between a thickness A of a coating layer and a value B of the arithmetic mean roughness Ra of the surface of a valve. As a result of application of the coating processing, the unevenness of the surface of the valve can be smoothed as shown in FIG. 12. Thus, the surface roughness can be reduced. However, in the coating layer, crack may be produced due to heat expansion of the valve as shown in FIG. 12.

With regard to the crack described above, by setting the thickness A of the coating layer so as to become equal to or less than the value B, the surface roughness of the coating layer can be prevented from becoming greater than the surface roughness of a valve without including the coating layer even if the crack is produced. That is to say, even if the crank is produced, the surface area can be prevented from becoming greater than that of the valve without including the coating layer.

Accordingly, the thickness of the intake front-surface coating layer 96 is set so as to become equal to or less than the arithmetic mean roughness Ra of the whole intake-valve-head front surface 92. Also, the thickness of the intake back-surface coating layer 98 is set so as to become equal to or less than the arithmetic mean roughness Ra of the whole intake-valve-head back surface 94. Similarly, the thickness of the exhaust front-surface coating layer 106 is set so as to become equal to or less than the arithmetic mean roughness Ra of the whole exhaust-valve-head front surface 102.

4-2. Advantageous Effects

As described so far, according to the present embodiment, the coating processing is applied to the intake-valve-head front surface 92, the intake-valve-head back surface 94 and the exhaust-valve-head front surface 102 that are mirror-finished. This can prevent rust from being produced on these surfaces 92, 94 and 102 due to the application of the mirror finish.

Moreover, the intake front-surface coating layer 96 is formed so as to become thinner than the intake back-surface coating layer 98. According to this kind of setting of the coating layer thickness, with regard to the intake front-surface coating layer 96 that is relatively thin, the heat capacity is reduced, and thus, the heat from a high temperature in-cylinder gas can be hard to transfer to the intake valve 90. On the other hand, with regard to the intake back-surface coating layer 98 that is relatively thick, this can be used as a heat insulating layer, and the surface area (heat-transfer area) can be effectively reduced because the roughness of the intake-valve-head back surface 94 is reduced due to thick coating. As a result, the heat from the intake valve 90 can be hard to transfer to the intake air that flows through the intake port 22.

Furthermore, according to the setting (B≥A) described with reference to FIG. 12, even if crack is produced in the coating layer 96, 98 or 106, the surface area (heat-transfer area) thereof can be prevented from becoming greater than that of a valve without including the coating layer. Because of this, the occurrence of the rust can be prevented while preventing the effect of the mirror finish from decreasing due to the application of the coating layers 96, 98 and 106.

5. Other Embodiments

According to the first to fourth embodiments described above, the intake-valve-head front surfaces 40, 72, 82 and 92, the intake-valve-head back surfaces 42, 74, 84 and 94, and the exhaust-valve-head front surfaces 46, 54 and 102 that are finished as mirror surfaces whose arithmetic mean roughness Ra is equal to or less than 0.5 μm, and the exhaust-valve-head back surfaces 48, 56 and 104 that is finished as rough surfaces whose arithmetic mean roughness Ra is greater than 0.5 μm are exemplified. However, "the intake-valve-head front surface, the intake-valve-head back surface, the exhaust-valve-head front surface and the exhaust-valve-head back surface" according to the present disclosure are not limited to the examples described above, as long as a relationship "the arithmetic mean roughness of the whole exhaust-valve-head back surface is greater than the arithmetic mean roughness of each of the whole intake-valve-head front surface, the whole intake-valve-head back surface and the whole exhaust-valve-head front surface" is satisfied. That is to say, the roughness of each of these surfaces may be relatively set such that the relationship described above is satisfied, without considering 0.5 μm as a threshold value of the arithmetic mean roughness Ra.

The embodiments and modification examples described above may be combined in other ways than those explicitly described above as required and may be modified in various ways without departing from the scope of the present disclosure.

What is claimed is:

1. An internal combustion engine, comprising:

an intake port and an exhaust port which communicates communicate with a combustion chamber;

an intake valve including an intake valve shaft and an intake valve head, the intake valve head being arranged at an end of the intake valve shaft and opening and closing the intake port; and an exhaust valve including an exhaust valve shaft and an exhaust valve head, the exhaust valve head being arranged at an end of the exhaust valve shaft and opening and closing the exhaust port, wherein the intake valve has a surface including an intake-valve-head front surface exposed in the combustion chamber when the intake valve is closed and an intake-valve-head back surface exposed in the intake port when the intake valve is closed, wherein the exhaust valve has a surface including an exhaust-valve-head front surface exposed in the combustion chamber when the exhaust valve is closed and an exhaust-valve-head back surface exposed in the exhaust port when the exhaust valve is closed, wherein an arithmetic mean roughness of the whole exhaust-valve-head back surface is greater than an arithmetic mean roughness of each of the whole intake-valve-head front surface, the whole intake-valve-head back surface and the whole exhaust-valve-head front surface, wherein the arithmetic mean roughness of the whole exhaust-valve-head back surface is greater than 0.5 μm, and wherein the arithmetic mean roughness of each of the whole intake-valve-head front surface, the whole intake-valve-head back surface and the whole exhaust-valve-head front surface is equal to or less than 0.5 μm.

2. The internal combustion engine according to claim 1, wherein at least one groove is formed in the exhaust-valve-head back surface.

3. The internal combustion engine according to claim 2, wherein the at least one groove includes a plurality of grooves that are formed in the exhaust-valve-head back surface so as to extend radially in a radial direction of the exhaust valve head.

4. The internal combustion engine according to claim 3, wherein each of the plurality of grooves is formed so as to become deeper at a portion of the exhaust valve head located radially outward than at a portion of the exhaust valve head located radially inward.

5. The internal combustion engine according to claim 1, wherein the arithmetic mean roughness of the whole of the exhaust-valve-head front surface and the exhaust-valve-head back surface is greater than the arithmetic mean roughness of the whole of the intake-valve-head front surface and the intake-valve-head back surface.

6. The internal combustion engine according to claim 1, wherein the arithmetic mean roughness of the whole exhaust-valve-head back surface is greater than the arithmetic mean roughness of the whole intake-valve-head back surface.

7. The internal combustion engine according to claim 1, wherein the arithmetic mean roughness of the whole intake-valve-head back surface is greater than the arithmetic mean roughness of the whole intake-valve-head front surface.

8. The internal combustion engine according to claim 1, wherein the arithmetic mean roughness of the whole exhaust-valve-head front surface is less than the arithmetic mean roughness of the whole intake-valve-head front surface.

9. The internal combustion engine according to claim 1, wherein an arithmetic mean roughness of a portion of the intake-valve-head front surface located radially outward of the intake valve head is greater than an arithmetic mean roughness of a portion of the intake-valve-head front surface located radially inward of the intake valve head.

10. The internal combustion engine according to claim 1, wherein an arithmetic mean roughness of a portion of the intake-valve-head back surface located radially outward of the intake valve head is less than an arithmetic mean roughness of a portion of the intake-valve-head back surface located radially inward of the intake valve head.

11. The internal combustion engine according to claim 1, wherein an arithmetic mean roughness of a portion of the exhaust-valve-head front surface located radially outward of the exhaust valve head is less than an arithmetic mean roughness of a portion of the exhaust-valve-head front surface located radially inward of the exhaust valve head.

12. The internal combustion engine according to claim 1, wherein an arithmetic mean roughness of a portion of the exhaust-valve-head back surface located radially outward of the exhaust valve head is greater than an arithmetic mean roughness of a portion of the exhaust-valve-head back surface located radially inward of the exhaust valve head.

13. The internal combustion engine according to claim 1, wherein the intake valve includes an intake front-surface coating layer which covers at least a part of the intake-valve-head front surface and an intake back-surface coating layer which covers at least a part of the intake-valve-head back surface, and wherein the intake front-surface coating layer is thinner than the intake back-surface coating layer.

14. The internal combustion engine according to claim 13, wherein a thickness of the intake front-surface coating layer is equal to or less than the arithmetic mean roughness of the whole intake-valve-head front surface.

15. The internal combustion engine according to claim 13, wherein a thickness of the intake back-surface coating layer is equal to or less than the arithmetic mean roughness of the whole intake-valve-head back surface.

16. The internal combustion engine according to claim 1, wherein the exhaust valve includes an exhaust front-surface coating layer which covers at least a part of the exhaust-valve-head front surface, and wherein the exhaust-valve-head back surface is not covered by a coating layer.

17. The internal combustion engine according to claim 16, wherein a thickness of the exhaust front-surface coating layer is equal to or less than the arithmetic mean roughness of the whole exhaust-valve-head front surface.

* * * * *